United States Patent [19]

Davies

[11] 3,976,123

[45] Aug. 24, 1976

[54] REFRIGERATION SYSTEM FOR CONTROLLED HEATING USING REJECTED HEAT OF AN AIR CONDITIONER

[76] Inventor: Thomas D. Davies, 11025 Stanmore Drive, Potomac Falls, Md. 20640

[22] Filed: May 27, 1975

[21] Appl. No.: 580,746

[52] U.S. Cl. ..... 165/29; 165/48; 62/183; 62/238

[51] Int. Cl.[2] ..... F25B 29/00

[58] Field of Search ..... 62/238, 183; 165/48, 165/29

[56] References Cited

UNITED STATES PATENTS

| | | | |
|---|---|---|---|
| 2,632,306 | 3/1953 | Ruff | 62/238 |
| 2,751,761 | 6/1956 | Borgerd | 62/238 |
| 3,188,829 | 6/1965 | Siewert et al. | 62/160 |
| 3,301,002 | 1/1967 | McGarth | 62/175 |
| 3,498,072 | 3/1970 | Stiefel | 62/118 |
| 3,513,663 | 5/1970 | Martin, Jr. et al. | 62/238 |

*Primary Examiner*—Albert W. Davis, Jr.
*Assistant Examiner*—James D. Liles
*Attorney, Agent, or Firm*—Finnegan, Henderson, Farabow & Garrett

[57] ABSTRACT

A refrigeration system is disclosed which utilizes the rejected heat from the condenser of an air conditioner to heat a second medium such as water for a swimming pool. A control is provided to maintain the temperature of the pool within a given range without degrading the performance of the air conditioning system and actually improving its economy and efficiency of operation. A heat exchanger, to place the second medium in heat exchange relationship with the refrigerant, is placed between the condenser unit and the expansion valve of the refrigeration system. The temperature of the refrigerant entering the heat exchanger is controlled by the on and off cycling of a fan to selectively move air across the coils of the condenser responsive to the temperature of the second medium.

8 Claims, 1 Drawing Figure

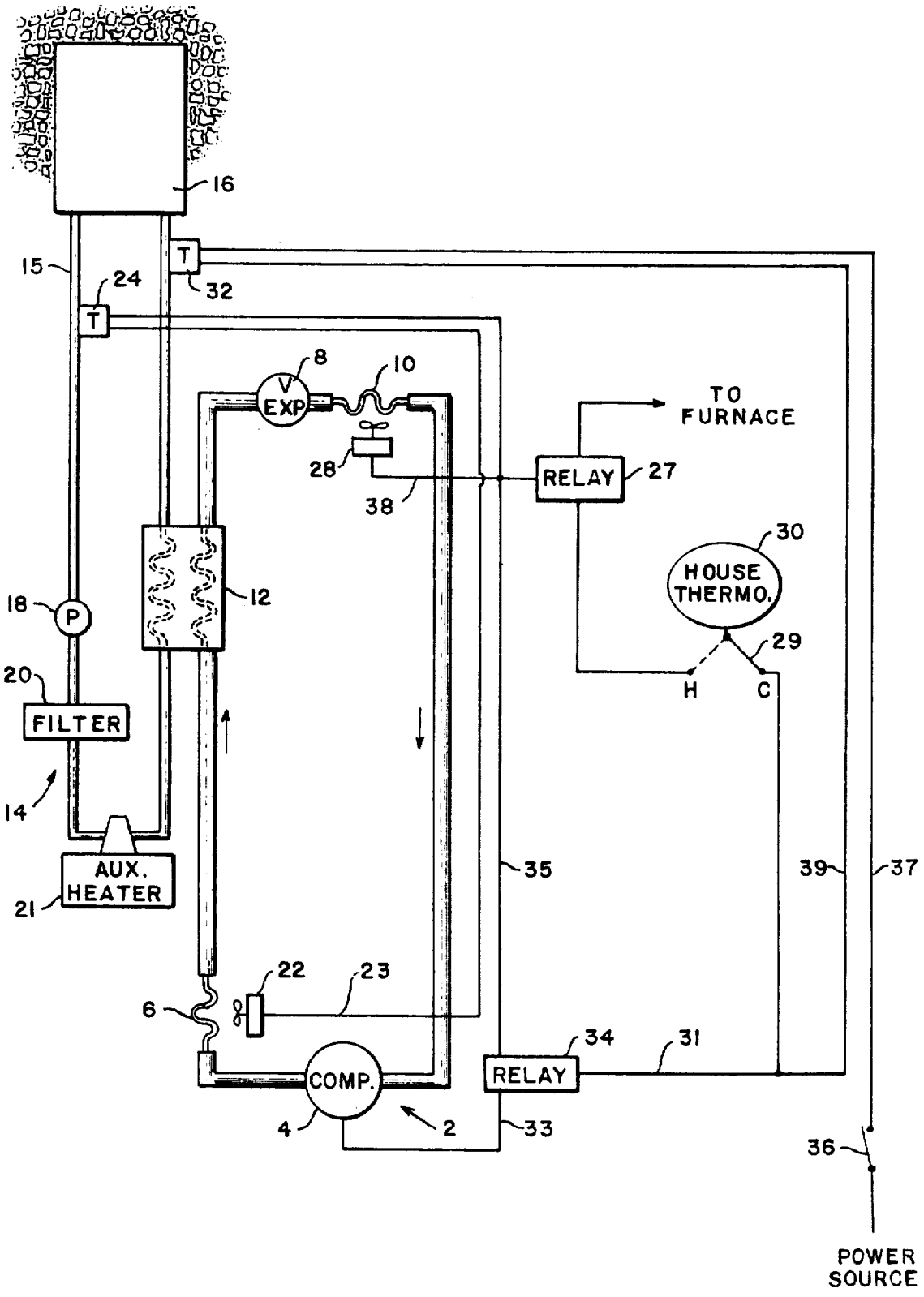
16
15
24
T
T
32
8
10
V
EXP
TO
FURNACE
28
38
RELAY
27
30
HOUSE
THERMO.
29
H
C
18
P
12
20
FILTER
14
AUX.
HEATER
21
35
39
37
22
23
6
34
31
RELAY
COMP.
4
2
33
36
POWER
SOURCE

REFRIGERATION SYSTEM FOR CONTROLLED HEATING USING REJECTED HEAT OF AN AIR CONDITIONER

BACKGROUND OF THE INVENTION

This invention relates generally to refrigeration systems. In particular, it is concerned with utilizing the heat which is normally rejected from an air conditioner system and controllably transferring it to a body of water such as a swimming pool.

The use of heaters to warm the water of a swimming pool is quite common among all swimming pool owners. Many existing systems use electric, gas or fuel oil heating units which are costly to operate.

Some types of pool heaters are particularly costly in terms of energy consumption, and for this reason some states have recently taken legislative action to prevent the use of pool heaters which consume gas and oil. Thus, the need for safe, economical and low energy-consuming pool heating systems is quite great.

Swimming pools have been heated in the past by utilizing the rejected heat from an air conditioning unit. However, such prior art systems have generally been unsatisfactory to properly control the system to maintain a substantially constant temperature of the water. Where there is no control or inadequate control, the amount of heat rejected from an average home air conditioning unit (2½ to 3½ ton capacity) will increase the pool temperature much above a desired point (usually 78°–86°) for comfortable swimming.

Some systems proposed, in order to maintain the constant temperature of the water, use thermostatic controls which cycle the home air conditioning unit off and on responsive to the temperature of the water, thereby controlling the amount of heat transferred to the water. Such units, however, can fail to adequately cool the house since the house thermostat is overridden by the thermostatic control responsive to the temperature of the pool water.

SUMMARY OF THE INVENTION

A refrigeration system is provided having a refrigeration loop including compressing means, a condenser, an expansion valve, and an evaporator connected serially for flow of refrigerant through the loop. A heat exchanger is placed in the refrigeration loop between the condenser and the expansion valve for bringing a secondary medium to be conditioned, such as water, into heat exchange relationship with the refrigerant. A fan adjacent the condenser, when turned on, moves air across the coils of the condenser and thereby removes heat from the refrigerant. The fan is controlled by a thermostat which is in heat sensing relation to the second medium water. When the fan is on and moving air across the condenser coil, the refrigerant temperature is reduced substantially to the temperature of that of the water so that at the heat exchanger no transfer of heat occurs. However, when the temperature of the water drops to some lower point, the thermostatic control causes the fan to cease operating and the refrigerant is passed from the condenser to the heat exchanger at a much higher temperature. Heat is transferred from the refrigerant to the water by means of the heat exchanging unit, and the pool temperature is increased.

BRIEF DESCRIPTION OF THE DRAWING

The refrigeration system of this invention is shown in the schematic circuit diagram of the FIGURE.

DESCRIPTION OF THE PREFERRED EMBODIMENT

Referring to the Figure, there is shown a refrigeration system which includes a loop 2 having serially connected compressing means here shown as compressor 4, condenser 6, expansion valve 8, and evaporator unit 10. Loop 2 contains a refrigerant, such as Freon, which flows continuously in the closed circuit of the system. This basic refrigeration loop is found in most home air conditioners.

The operation of a common refrigeration circuit such as loop 2 without the insertion of a heat exchanger 12 (to be discussed in detail below) follows. The compressor 4 acts on a gaseous refrigerant to compress it to a high pressure super-heated gas state. The super-heated refrigerant thereafter flows into the condenser unit 6, wherein cold water passes over the coils or air flow is used across the coils to dissipate the heat from the refrigerant. The refrigerant leaves the condenser as a saturated liquid under high pressure flowing to the expansion valve 8. The expansion valve 8 acts to reduce the pressure on the saturated liquid refrigerant, and the refrigerant, cooled in the expansion process, flows into the evaporator. Usually an air handler or fan 28 moves warm room air over the evaporator coils as the refrigerant expands, removing heat from the air. The refrigerant flows from the evaporator unit 10 as a saturated gas under low pressure back through the compressor 4 and begins a new refrigeration cycle.

According to the present invention, a heat exchanger unit 12 is positioned between the condenser 6 and expansion valve 8. The heat exchanger unit 12 brings the refrigerant into a heat transfer relationship with a second liquid medium which in this case is water for a swimming pool. A typical heat exchanger unit uses coils of tubing to carry the water, the tubing having an outer concentric jacket to carry the refrigerant in close heat exchange proximity to the water.

A second loop 14, in which the second medium (hereinafter referred to as the pool water) is cycled through piping 15, includes a swimming pool 16, circulation pump 18, filter 20 and if desired, a pool heater 21. The heater 21 is included only as a supplemental source of heat and is not essential to the operation of this invention. The pump preferably moves the water through loop 14 as necessary to continuously filter the pool water and is a normal adjunct to most permanently installed pools. Filter 20 operates to keep the pool water clear of dirt and debris.

According to this invention, means, such as a first fan 22, is positioned adjacent to the condenser 6 to remove heat from the refrigerant flowing through the coils of condenser 6. Preferably, the fan 22 moves air across the coils, thereby removing heat from the refrigerant. Alternatively, cold water can be passed over the tubing of the condenser coils to also remove heat from the refrigerant. In the latter case, the cold water necessarily would be circulated through a cooling tower to be recycled over the condenser 6.

As here embodied, the fan 22 is connected to thermostat 24 located in piping 15 in which the pool water flows or can be located in the pool 16 itself. When the air conditioning system is operating, thermostat 24, being in heat sensing relation to the pool water and connected directly to fan 22 by connecting line 23, controls the operation of fan 22 in accordance with the temperature sensed. It will be understood that if the fan 22 were replaced by a source of cold water whose flow over the condenser coils was controlled by, for instance, a valve, the valve would respond to the thermostat 24 to stop and start the flow of water in accordance with the temperature sensed.

Preferably, the house thermostat 30, located in the enclosed area to be cooled, is set for cool by moving switch 29 to the cool setting and the compressor 4 is cycled on and off responsive to the temperature setting of the house thermostat 30 through air conditioning relay 34. Lines 31 and 33 connect the house thermostat 30 through relay 34 to compressor 4. When the temperature in the enclosed area exceeds the temperature setting of the thermostat 30, the compressor 4 is cycled on. When the temperature drops into an acceptable range, the compressor 4 is then cycled off by the thermostat 30.

Additionally, the house thermostat 30 is preferably connected through relay 34 to thermostat 24 by line 35. As long as switch 29 of house thermostat 30 is on the cool setting, the thermostat 24 controls the operation of fan 22.

Preferably, during the periods that compressor 4 is operating on the refrigerant, the thermostat 24 cycles on fan 22 responsive to a first temperature of the pool water and cycles off the fan responsive to a second lower temperature of the pool water. Thereby, the heat content of the refrigerant flowing from the condenser 6 into the heat exchanger 12 is controlled in a manner tending to increase the heat content when the temperature of the pool water drops and to decrease the heat content when the temperature of the pool water rises.

In operation, the transfer of heat to the pool water does not interfere with the refrigeration and cooling capabilities of refrigeration loop 2. Indeed, by transferring heat to the pool water, the power required for the air conditioning or refrigeration loop 2 is decreased by the amount of energy which would otherwise be consumed by operating the fan 22 to remove heat from the refrigerant, thus increasing the overall efficiency. It is estimated that in an average home air conditioning unit the amount of energy conserved is normally about 10 per cent of the total required to operate the system.

For the preferred operation of the air conditioning system to cool, for instance, a room or rooms of a house, a second fan 28 is positioned adjacent the coils of the evaporator 10 to force warm room air over the coils, thereby cooling the air. The fan 28, connected to air conditioning relay 34 by lines 35 and 38, is responsive to the house thermostat 30 coming on when the compressor 4 is on to force cool air into the room or rooms. When the temperature within the area to be cooled is reduced to a given lower temperature and the compressor 4 is cycled off, the thermostat control 30 through relay 34 and lines 35 and 38 turns off fan 28. The described operation of the house thermostat 30 and fan 28 in conjunction with the evaporator unit 10 is normal for most house air conditioning units. But fan 28 also can, in many systems, be placed on manual operation so that it will operate continuously. Continuous operation of fan 28 is compatible with the present invention. It will be appreciated that another liquid can be cooled rather than air and circulated to the rooms to be cooled, as is common in some air conditioning systems.

A major advantage which derives from the present invention is the economy and efficiency of the combined heating and air conditioning system. This particular system is, in fact, more economical and more efficient than the air conditioning system if operated without any transfer of heat to the pool water. Thus, the system gives greater conditioning capability and provides selective heating of a swimming pool and cooling of an enclosed area for less cost than does a single purpose cooling system.

Another important feature of this invention is the ease of converting an existing system to include the capability of heating a swimming pool at a very low cost. Thus, only a heat exchanger and thermostatic control (12 and 24) with the associated connections and wiring need be installed with most existing systems to give the house air conditioning system the capability of simultaneously heating a swimming pool.

It has been further found in practical use that this system, if used in a climate similar to that found in Washington, D.C., provides sufficient heat from a normal air conditioner condenser to provide a comfortable swimming pool temperature (78°–86°F) throughout the normal swimming pool season, or from about May 15 to October 1. Application of this system will vary from location to location, depending upon the climate, but in many cases, will entirely eliminate the need for any other swimming pool heater.

Another feature of the refrigeration control system according to this invention is to use a furnace (not shown) with the air conditioner as an option for anomolous spells of weather when operation of the air conditioner alone is inappropriate. A second thermostatic control 32 is included which also is located in piping 15 in heat sensing relationship to the pool water. This thermostatic control 32, when the outside temperature is low as in late Fall or early Spring, or during an unusual summer cold spell, operates the air conditioner at the same time that the house thermostat 30 is switched to heat and operates the heating system.

The second thermostatic control 32 is connected by line 37 to a power source through a switch 36. The thermostat 32 is connected to relay 34 through lines 39 and 31, thereby bypassing the house thermostat 30 when switch 29 is at the heat setting. Relay 34 is, of course, connected to compressor 4 by line 33. When switch 29 of house thermostat 30 is set to heat, it is connected through heating relay 27 to fan 28 to move warm air from the furnace into the area to be heated. It will be recognized that other than a forced air heating system can be used with this invention also.

In operation, the switch 36 is turned on to activate the thermostatic control 32 when the house thermostat 30 is set for furnace operation. When the temperature of the pool water drops below a desired point as sensed by thermostatic control 32, the compressor 4 is turned on and the air conditioner operates simultaneously with the furnace. Heat is transferred at heat exchanger 12 to the pool water from the super-heated refrigerant under the control of thermostatic control 24 as previously explained. Since normally the heat capacity of the furnace exceeds the cooling capacity of the air conditioner, the enclosed area will be heated responsive to the temperature setting of the house thermostat 30.

Thus, in a season when the temperature is colder than during the normal swimming season, the low swimming pool temperature detected by thermostatic control 32 causes the air conditioner through relay 34 to start, thereby cooling the house and simultaneously heating the pool. The house thermostat registering a lower house temperature as a result of the air conditioner operation then starts the house heating system through heating relay 27 to bring the house temperature up to a comfortable temperature. This type of system is particularly desirable where a pool enclosure or bubble is used and heating is, therefore, desired late into the Fall or in early Spring.

No additional special purpose pool heater is required, even during the time that the air conditioner would normally not be operating. An economy is, therefore, achieved by the elimination of the separate pool heater, even though the reduction in operating cost achieved during air condition season would no longer be available. The higher cost of operation during these extra-season periods would be more than offset by the no-cost heating during the normal season.

What is claimed is:

1. In a refrigeration system, having a refrigeration loop including compressing means, a condenser having coils, expansion means, and an evaporator connected serially for flow of refrigerant therethrough, the combination of a heat exchanger between said condenser and said expansion means for bringing a secondary medium to be conditioned into heat exchange relationship with the refrigerant, means next adjacent said condenser for removing heat from said refrigerant, a thermostat in heat sensing relation to said second medium, said means being connected to said thermostat to cycle on said means responsive to a first temperature and to cycle off said means responsive to a second temperature lower than said first temperature thereby controlling the heat content of said refrigerant flowing into said heat exchanger in a manner tending to increase the heat content when the temperature of said second medium drops and to decrease the heat content when the temperature of said second medium rises.

2. The refrigeration system of claim 1 wherein said second medium is water.

3. The refrigeration system of claim 1 further including means adjacent said evaporator for moving air across said evaporator into some enclosed area to condition said area.

4. The refrigeration system of claim 3 wherein said means for removing heat from said refrigerant is a first fan for moving air across said condenser.

5. The refrigeration system of claim 3 further including a swimming pool and circulation pump connected in a circuit with said heat exchanger for flow of said second medium.

6. The refrigeration system of claim 3 further including a second thermostat in heat sensing relation to said second medium, a power switch connected to said thermostat to activate said thermostat when said refrigeration loop is otherwise inoperative, and said compressing means being responsive to said second thermostat to cycle said compressing means on at a first temperature and off at a second higher temperature of said second medium.

7. The refrigeration system of claim 6 further including a home thermostat for sensing temperature in an enclosed area, a furnace for heating air, said furnace being cycled on and off in accordance with the temperature sensed by said house thermostat, and said means adjacent said evaporator for moving air being so positioned to move the heated air from said furnace into said enclosed area.

8. The refrigeration system of claim 1 further including means adjacent and in heat-exchange relation to said evaporator to transfer heat to a liquid for transport to some enclosed area to condition said area.

* * * * *